United States Patent [19]

Bathurst et al.

[11] Patent Number: 5,033,209

[45] Date of Patent: Jul. 23, 1991

[54] DIELECTRIC OVERSHOES

[75] Inventors: Clyde E. Bathurst, Riverview; James M. Forte, Cincinnati, Ohio

[73] Assignee: Utility Manufacturers, Inc., Riverview, Mich.

[21] Appl. No.: 416,908

[22] Filed: Oct. 4, 1989

[51] Int. Cl.[5] ..... A43B 3/00

[52] U.S. Cl. ..... 36/7.3; 36/113; 182/221

[58] Field of Search ..... 36/7.3, 4, 84, 113, 36/50, 7.1 R; 182/221, 134

[56] References Cited

U.S. PATENT DOCUMENTS

| | | | |
|---|---|---|---|
| 330,592 | 11/1885 | Lavey | 36/50 |
| 331,036 | 11/1885 | Crampton | 36/50 |
| 938,905 | 11/1909 | Speerstra | 182/221 |
| 1,556,167 | 10/1925 | Smiley | 36/50 |
| 2,284,190 | 5/1942 | Evans | 36/7.3 |
| 2,362,518 | 11/1944 | Woodbury | 182/221 |
| 2,617,208 | 11/1952 | Marx et al. | 36/7.3 |
| 2,617,209 | 11/1952 | Jackson | 36/7.3 |
| 3,724,107 | 4/1973 | Makinen et al. | 36/7.3 |
| 4,524,530 | 6/1985 | Greenway | 36/113 |

*Primary Examiner*—Steven N. Meyers

*Attorney, Agent, or Firm*—Dykema Gossett

[57] ABSTRACT

An improved dielectric overshoe is disclosed in which upper portions are formed of a first rubber composition having good dielectric characteristics and lower portions and a sole are formed of a second rubber composition that has good dielectric characteristic, but has slightly better wear characteristics than the first rubber composition. The shoe has a high arch to provide room for the mounting of a climbing cleat. Buckles seal the tongue of the shoe, with an uppermost one of the buckles being spaced from an opening for receiving a wearer's foot by a distance great enough to provide room for mounting of a strap to secure a climbing cleat to the overshoe. A reinforcement lip is placed around the entire opening, and in combination with the buckles and the tongue provides a nearly water-tight seal between the overshoe and the wearer's ankle preventing seepage of any water into the overshoe opening.

7 Claims, 2 Drawing Sheets

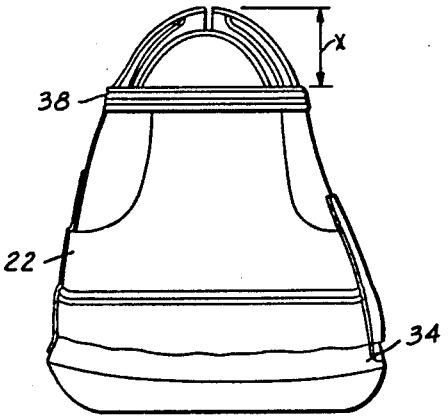
FIG.5
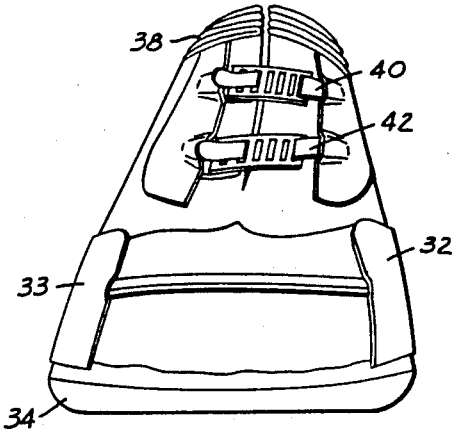
FIG.6
FIG.7
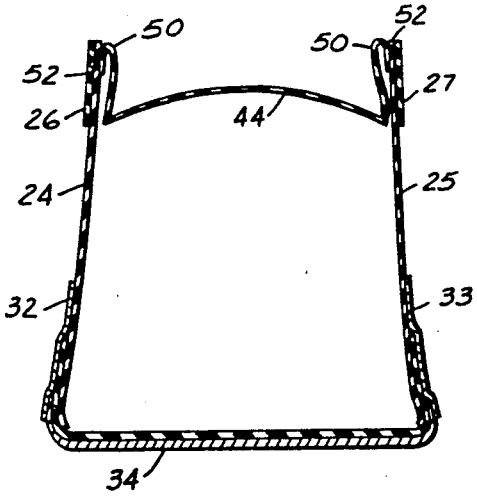
FIG.8
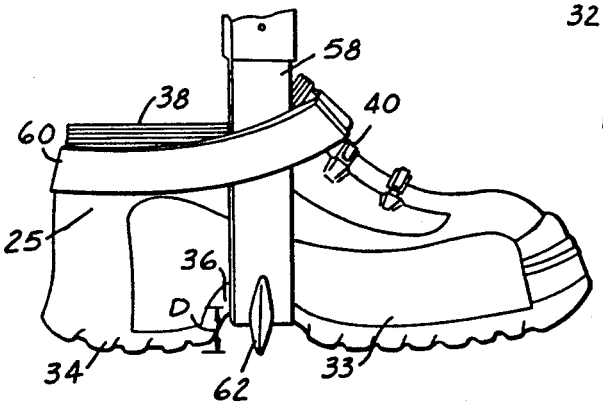
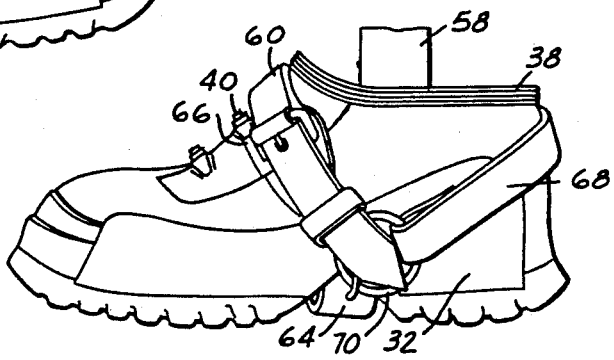
FIG.9

DIELECTRIC OVERSHOES

BACKGROUND OF THE INVENTION

This application relates to dielectric overshoes for use by electrical workers, and more particularly relates to an improved dielectric overshoe that has a combination of rubber compositions and overshoe configurations such that it gives adequate protection and long-wearing use to a wearer.

Dielectric boots are known that are formed of various rubber compositions. These boots are either of the overshoe type which are worn over the footwear of a wearer or a type which cover the foot of the worker in place of a shoe. These prior art boots typically have an open tongue and hang loosely about the wearer's ankle.

In addition, there were prior art boots that covered only the foot and that were buckled closed. However, these may not have been dielectric boots formed of rubber to provide insulation to an electrical worker. In addition, dielectric boots may have been known that cover the wearer's leg up to a point below the knee and which had fasteners to close the front of the boot.

In general, the prior art boots are undesirable in that they either did not provide sufficient dielectric qualities, or might allow seepage of liquids, such as water, into the boot since it was not tightly sealed about a wearer's ankle. In addition, these prior art boots were not always compatible with various climbing equipment that is commonly used by electrical workers.

Standards have recently been enacted by the American Society of Testing Materials to provide requirements for overshoe footwear that is to be labeled as "dielectric overshoe footwear". These standards, ASTM F 1117-87, relating to "Rubbers", designed to be worn over existing footwear and to cover only the foot of the worker, require that an overshoe "Rubber" be given an electric proof test, and withstand a 60-Hz alternating current proof test voltage, or a direct current proof-test voltage. The proof test are applied continuously to the overshoe for a minimum of one minute to a maximum of three minutes. The alternating current proof test for "Rubbers" provides a 15,000 voltage proof-test voltage, and the direct current proof-test is 45,000 volts.

There are various procedures for testing an overshoe. In a first procedure, an overshoe is filled with water, or a conductive metal shot, so that the inner sole is completely covered. The overshoe is then placed in water to a depth such that the underside of the sole is in contact with the water without the water going above the top part of the sole. The water, or metal shot, inside the footwear forms one test electrode and is connected to one terminal of a voltage source by means of a chain or a sliding rod that dips into the water, or metal shot, in the overshoe. The water in the container outside the overshoe forms the other electrode and is connected directly to the other terminal of the voltage source.

When this procedure is utilized, a test reading of one mA between the electrodes indicates that the shoe has failed the test.

Another test procedure is utilized in which the footwear is immersed to a level even to the top of the foot. With this test procedure, a current reading of 10 mA is allowed before the shoe fails the test.

It has proven difficult for many of prior art overshoes, or "Rubbers", to meet these test standards.

Thus, it is an object of the present invention to disclose a dielectric overshoe that can meet the testing standards noted above and in addition, will provide long-wearing use to a wearer.

Also, it is an object of the present invention to disclose an improved dielectric overshoe that is compatible with various types of climbing equipment that are commonly used by electric workers.

SUMMARY OF THE INVENTION

The present invention discloses an improved dielectric overshoe having a two-part rubber composition with an upper portion formed of a first rubber composition that has better dielectric qualities than a second rubber composition that forms the lower portion, and the sole of the overshoe. The second rubber composition has better wear characteristics than first rubber composition. It is most important that the upper portion have better dielectric, or insulation, properties per unit of material than the lower portion since the upper portion will tend to be thinner than the lower portion. In addition, the upper portion is often exposed to sparking from exposed power lines. The lower portions and the sole tend to be thicker portions and thus can utilize a rubber composition having less dielectric qualities.

The two rubber compositions of the present invention may preferably include a first rubber composition that is 90% natural rubber and 10% artificial rubber and a second rubber composition that is 80% natural rubber and 20% artificial rubber. Artificial rubber has a higher carbon content than natural rubber and is longer wearing than natural rubber. However, natural rubber is known to have better dielectric characteristics. In addition, natural rubber is much more expensive than synthetic rubber and thus the use of a higher synthetic rubber content for the lower portions results in material cost savings.

The dielectric overshoe of the present invention includes an arch that extends for a distance above a plane of the sole to allow for the attachment of a climbing cleat or the like. The lower portion, formed of the better wearing second rubber composition, extends vertically above the arch such that there is a higher wear characteristic portion directly above the arch to protect the overshoe from wear due to friction with a climbing cleat, or any other climbing tool that may be utilized.

The improved overshoe of the present invention has an expandible tongue that is closed by buckles and which snugly seals around a wearer's ankle. In addition, a reinforced lip portion is mounted along an opening of the overshoe that receives a wearer's foot. This reinforcing lip portion ensures a good seal between the overshoe and the wearer's ankle.

The buckles utilized to close the tongue consist of two vertically spaced buckles, the uppermost of which is spaced from the reinforcing lip at the opening by a distance great enough to provide room for a strap that is commonly utilized to secure a climbing cleat to a shoe.

In addition, the front of the opening extends to a vertical position higher than the rear of the opening. This facilitates mounting of the strap mentioned above, and ensures comfortable wear of the overshoe in combination with the strap, especially while climbing.

These and other objects of the present invention can be best understood from the following specification and drawings of which the following is a brief description.

BRIEF DESCRIPTION OF THE DRAWINGS

FIG. 5 is a back view of the overshoe illustrated in FIG. 1.

FIG. 6 is a front view of the overshoe illustrated in FIG. 1.

FIG. 7 is a cross-sectional view through the tongue of the overshoe illustrated in FIG. 1.

FIG. 8 is an inner side view of a left foot overshoe with a climbing cleat mounted thereon.

FIG. 9 is an outer side view of a left foot overshoe with a climbing cleat mounted thereon.

DETAILED DESCRIPTION OF A PREFERRED EMBODIMENT

Figure 1:
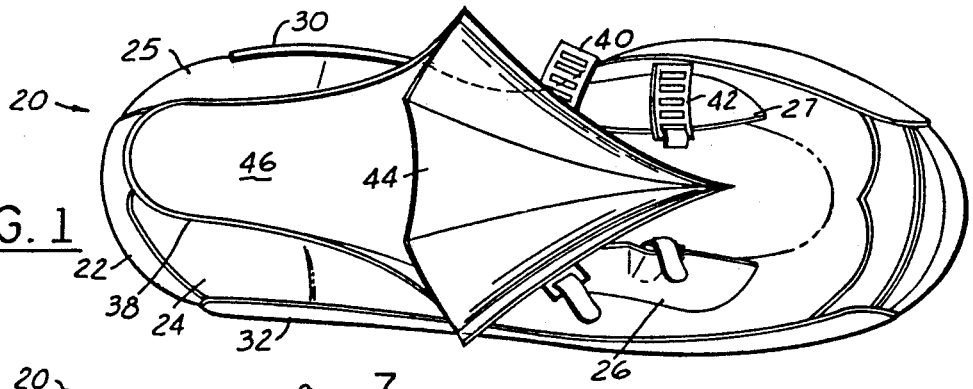
FIG. 1 is a top view showing a right foot overshoe according to the present invention.

A top view of an improved dielectric overshoe 20 is illustrated in FIG. 1 which shows opening 46 that may be sealed tightly closed by buckles 40 and 42. It is to be understood that tongue 44 is secured to side pieces 24 and 25 and thus provides a complete seal preventing seepage of water through the area of tongue 44 into opening 46. Reinforced lip 38 also seals tightly around a wearer's ankle area to prevent seepage of any water into opening 46. Reinforced lip 38 also helps to prevent tearing of the upper portion of overshoe 20.

Figure 2:
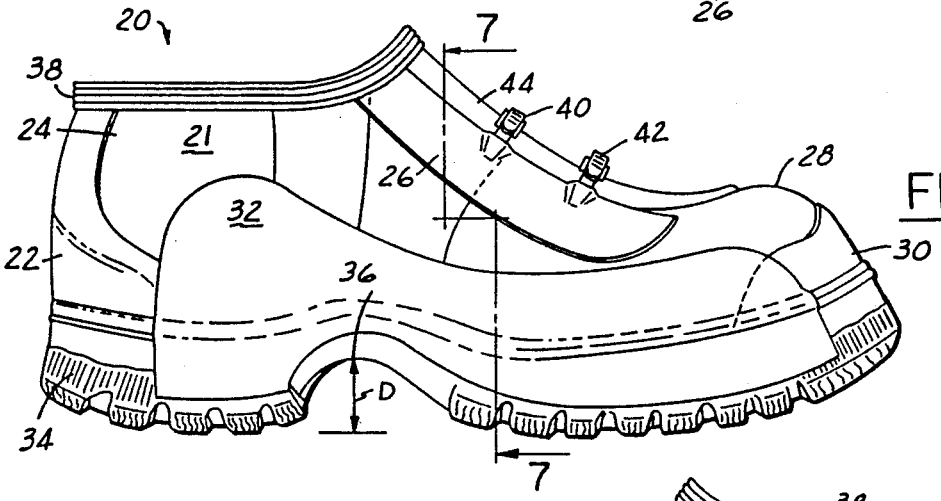
FIG. 2 is a outer side view of the overshoe illustrated in FIG. 1.

As shown in FIG. 2, dielectric overshoe 20 has upper portion 21 formed of a series of pattern pieces including back piece 22, outer side piece 24, outer side piece 26, upper toe piece 28, lower toe piece 30. Outer lower portion 32 and sole 34 are mounted at the vertically lower positions of dielectric overshoe 20. Arch 36 extends a distance D, that may be $\frac{7}{8}$" to 1", upwardly from the plane of sole 34. Reinforced lip 38 extends around opening 46. Upper buckle 40 and lower buckle 42 close tongue 44, thus sealing opening 46 and reinforced lip 38 about the ankle area of a wearer.

Upper portion 21 is formed of a first rubber composition that has good dielectric characteristics. Lower portion 32, and sole 34, are formed of a second rubber compoisition that has good dielectric characteristics, but also has improved wear characteristics over upper portion 21. These two rubber compositions are arrived at by mixing various percentages of natural and synthetic rubbers. The greater the percentage of natural rubber, the better the dielectric characteristics. However, synthetic rubber has a higher carbon content than natural rubber, and thus has better wear characteristics than natural rubber. For this reason, lower portion 32 and sole 34 are formed of a rubber composition that has a higher synthetic rubber percentage. In addition, synthetic rubber is significantly cheaper than natural rubber and it is advantageous to use it in greater percentages on the sole 34 and lower portion 32 which are relatively thick when compared to upper portion 21.

An example of a first material that may preferably be used for the first rubber composition of upper portion 21 is a rubber composition composed of 90% natural rubber and 10% synthetic rubber. Such a composition is available from Ranger Rubber Company, a division of Endicott Johnson Shoe Company of Endicott, New York and identified as "Formula 096".

A second material that is preferably utilized to form the lower portion 32 and sole 34 is composed of 80% natural rubber and 20% synthetic rubber. This composition is also available from Ranger Rubber Company and is identified as "Formula 1172".

Figure 3:
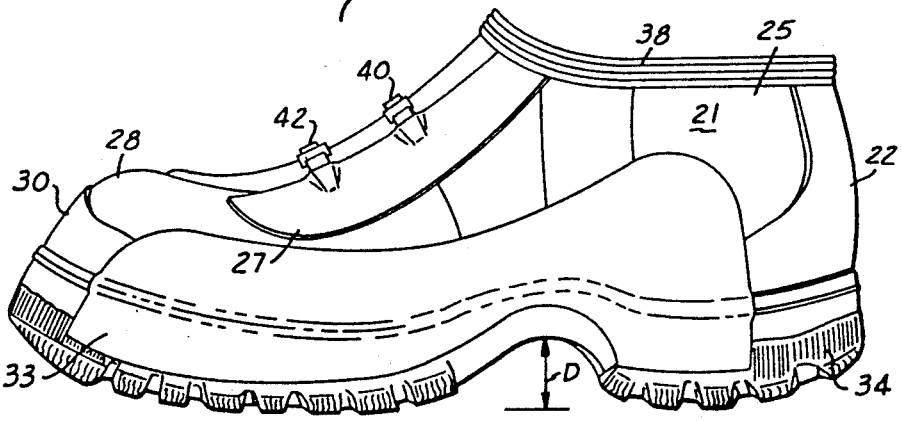
FIG. 3 is an inner side view showing of the overshoe illustrated in FIG. 1.

FIG. 3 shows the inner side of improved dielectric overshoe 20 and includes many parts similar to those identified in FIG. 2, which are identified by the same reference numerals. FIG. 3 shows inner side piece 25 and inner side piece 27 along with inner lower portion 33.

Figure 4:
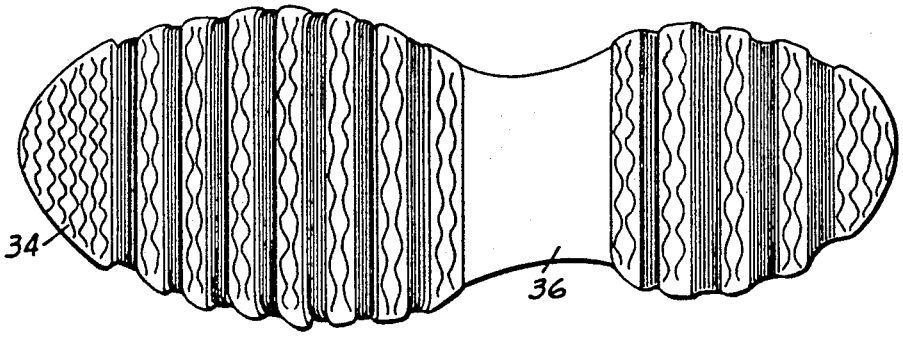
FIG. 4 is a bottom view of the overshoe illustrated in FIG. 1.

FIG. 4 is a bottom view of improved dielectric overshoe 20 and illustrates sole 34 and arch 36.

FIG. 5 shows a rear view of improved dielectric shoe 20 including back piece 22 and a reinforcement lip 38. Distance X is illustrated and defines the amount that the front of opening 46 extends vertically upwardly above the rear of opening 46. Having the front of opening 46 being vertically above the rear provides better support from overshoe 20 when a wearer is climbing or wearing some sort of climbing tool, such as a climbing cleat or the like.

FIG. 6 is a front view of improved dielectric overshoe 20 having buckles 40 and 42 tightly sealed and reinforcing lip 38 tightly closed to provide a seal that prevents seepage of water into opening 46.

FIG. 7 is a cross-sectional view through tongue 44, side portions 24 and 25 and side pieces 26 and 27. As can be seen, tongue 44 has portions 50 fixed to both inner and outer sides 24 and 25 at sealed joints 52.

An improved dielectric overshoe 20 for the left foot is shown with a climbing cleat 58 mounted to it in FIG. 8. The left foot overshoe is a mirrored image of the right foot overshoe illustrated in FIGS. 1–7. As shown, climbing cleat 58 is mounted by strap 60 below reinforcement lip 38 and has a cleat member 62 extending laterally inwardly from arch 36 of dielectric overshoe 20. Arch 36 extends vertically upwardly to a distance D that is adequate to allow a worker to walk normally while wearing climbing cleat 58. In addition, upper buckle 40 is spaced vertically downwardly along tongue 44 from reinforcement lip 38 to such an extent that strap 60 can be received between reinforcement lip 38 and upper buckle 40. Thus, strap 60 can be tightly received upon dielectric shoe 20 and firmly hold climbing cleat 58 with respect to overshoe 20. The distance X, discussed above, also provides room for strap 60 such that climbing cleat 58 may be firmly held to overshoe 20 while at the same time strap 60 will not be in contact with, or digging into, a wearer's foot, or ankle.

FIG. 9 illustrates an outer side of dielectric overshoe 20 having climbing cleat 58 mounted thereon. As shown, climbing cleat 58 has an attachment portion 64 attached through ring 70 to buckle 66 of belt 60. Thus, belt 60 can be tightened within buckle 66 and climbing cleat 58 will be firmly received upon arch portion 36. A rear portion 68 of strap 60 is also connected to ring 70 to complete the attachment of climbing cleat 58 to overshoe 20.

The placement of lower portion 32 having high wear characteristics above arch 36 allows the friction that takes place between climbing cleat 58 and overshoe to be compensated for. Without the provision of the higher wear characteristic lower portion 32, overshoe 20 may wear out quite quickly. The provision of the distance between uppermost buckle 40 and reinforcement lip 38 being great enough to provide room for climbing cleat strap 60 allows climbing cleat 58 to be utilized comfortably with improved dielectric overshoes 20. The distance between uppermost buckle 40 and reinforcement lip 38 may be between 1½" and 1¾", which prevents strap 60 from digging into a wearer's foot as would be experienced if this distance were inadequate. If this distance were inadequate, strap 60 might overlie buckle 40 and abrade buckle 40 to cause it to seperate from overshoe 20. In addition, if strap 60 overlies buckle 40, the buckle will dig into the top of a wearer's foot which would be uncomfortable.

The disclosed overshoe 20 provides a substantially completely sealed opening 46 in combination with dielectric characteristics that meet, and exceed the ASTM standards mentioned above, while at the same time being useful with climbing tools, such as climbing cleat 58. It should be understood that the features of this invention will apply to shoes or boots other than overshoes.

A method for forming overshoe 20 will now be disclosed. A rubber composition having the proper percentages of natural and synthetic rubber is prepared. A sulphur may be utilized to cure the rubber composition. Sheets of the rubber composition are prepared for each of the two compositions that will be utilized in forming the shoe. The various pattern pieces are cut by a die cutter into the required shapes.

A metal last is then wrapped with fabric liner pieces and the rubber pattern pieces are placed over these fabric pieces upon the last. Buckles 40 and 42 are set upon the pattern pieces prior to side members 26 and 27 being placed over buckles 40 and 42. The last, with the fabric pieces and the pattern pieces, is then cured by an ammonia vulcanization process to bind all the parts together.

The various method steps are well known in the field of rubber shoe manufacturing.

This shoe may be utilized by tree trimmers, linemen, splicers, or any workers involved in any field of electrical work where they may be exposed to high voltage sources.

An embodiment of an improved dielectric shoe has been disclosed, however, those skilled in the art will recognize that certain modifications would be within the scope of the disclosed invention and thus reference should be had to the following claims in order to determine the true scope and content of the present invention.

We claim:

1. A dielectric shoe comprising:

a shoe formed of rubber having an opening;

a tongue extending forwardly from said opening, a reinforcement lip mounted around said opening, said reinforcement lip being vertically higher at a forward position than at a rear position, buckles mounted on said tongue for closing said tongue, the combination of said reinforcement lip, and said buckled tongue ensuring that said shoe will be tightly sealed around a wearer's ankle when buckled;

said shoe further having a sole portion, said tongue and said lip of said shoe being formed of a first material, said sole being formed of a second material, said first material having better dielectric characteristics than said second material, and said second material having better wear characteristics than said first material;

said tongue being disposed between inner and outer upper portions of said shoe, said tongue extending between and being connected to, said inner and outer upper portions, said inner and outer upper portions extending from a forward end of the shoe rearwardly toward a rear end, said forward end of said inner and upper positions being connected by a lower toe portion and said rear end of said inner and outer upper being connected by a back portion of said shoe, said inner and outer upper portions, said lower toe portion and said back portion all being formed of said first material;

said sole having an arch extending vertically upwardly, a lower portion being formed of said second material and mounted about said arch, said lower portion extending vertically upwardly to a first distance in a forward portion of said shoe, said lower portion curving upwardly to a second distance greater than said first distance, or said arch, around said arch, to provide an area of high wear material above said arch, said lower portion extending between said lower toe and back portions, but not entirely covering said lower toe and back portions, such that the outer surface of said shoe include surface of said first material ta said lower toe portion and said back portion and at heights between said first and second distances, and portions of said second material where said lower portion defines the outer surfaces of said shoe between said lower toe and back portions.

2. A dielectric shoe as recited in claim 1, wherein an uppermost one of said buckles being spaced from said reinforcement lip by a first distance greater than the width of a climbing cleat strap to provide sufficient space for receiving a climbing cleat strap between said uppermost buckle and said reinforcement lip.

3. A dielectric shoe as recited in claim 2, wherein said first distance is between 1½" and 1¾".

4. A dielectric shoe as recited in claim 1, wherein said first and second materials are both rubber compositions formed of a combination of natural and synthetic rubbers.

5. A dielectric shoe as recited as in claim 4, wherein said first material has a higher natural rubber content than said second material.

6. A dielectric shoe as recited in claim 5, wherein said second material has a higher synthetic rubber content than said first material.

7. A dielectric shoe as recited in claim 1, wherein a climbing cleat strap is received around said shoe and above an uppermost one of said buckles.

* * * * *